US009332808B2

(12) United States Patent
Benz et al.

(10) Patent No.: US 9,332,808 B2
(45) Date of Patent: May 10, 2016

(54) FOOTWEAR WITH ENHANCED CLEATS

(75) Inventors: Erek Benz, Park Ridge, IL (US); David Pickard, Buffalo Grove, IL (US); Daniel T. Nicholson, Chicago, IL (US); Christian D. Anderson, Montgomery, IL (US)

(73) Assignee: Position Tech, LLC, Chicago, IL (US)

( * ) Notice: Subject to any disclaimer, the term of this patent is extended or adjusted under 35 U.S.C. 154(b) by 585 days.

(21) Appl. No.: 13/004,456

(22) Filed: Jan. 11, 2011

(65) Prior Publication Data

US 2011/0167676 A1 Jul. 14, 2011

Related U.S. Application Data

(60) Provisional application No. 61/294,320, filed on Jan. 12, 2010, provisional application No. 61/374,469, filed on Aug. 17, 2010.

(51) Int. Cl.
*A43C 15/16* (2006.01)

(52) U.S. Cl.
CPC ..... *A43C 15/162* (2013.01); *A43C 15/164* (2013.01); *A43C 15/167* (2013.01)

(58) Field of Classification Search
CPC ..... A63C 13/04; A63C 15/00; A63C 15/16; A63C 15/164; A63C 15/165; A63C 15/167; A63C 15/162
USPC ..... 36/62, 64–66, 67 A, 67 D, 126, 128, 134
See application file for complete search history.

(56) References Cited

U.S. PATENT DOCUMENTS

| | | | |
|---|---|---|---|
| 2,185,397 | A | 1/1940 | Birchfield |
| 3,672,077 | A | 6/1972 | Coles |
| 4,107,858 | A | 8/1978 | Bowerman et al. |
| 4,233,759 | A | 11/1980 | Bente et al. |
| 4,586,274 | A | 5/1986 | Blair |
| 4,660,304 | A | 4/1987 | Tanel |
| 4,667,425 | A | 5/1987 | Effler et al. |
| 4,698,923 | A | 10/1987 | Arff |
| 5,483,760 | A | 1/1996 | Kataoka et al. |
| 5,628,129 | A | 5/1997 | Kilgore et al. |

(Continued)

FOREIGN PATENT DOCUMENTS

| | | | | |
|---|---|---|---|---|
| CN | 2829422 | Y | 10/2006 | ..... A43C 15/16 |
| DE | 102008025289 | A1 | 12/2009 | ..... A43C 15/16 |

(Continued)

OTHER PUBLICATIONS

International Search Report, Jun. 6, 2011.

(Continued)

*Primary Examiner* — Khoa Huynh
*Assistant Examiner* — Sharon M Prange
(74) *Attorney, Agent, or Firm* — Sunstein Kann Murphy & Timbers LLP

(57) ABSTRACT

A shoe includes a sole having a plurality of cleats thereon at spaced apart locations. The cleats are configured to enhance the performance of the shoe based upon the specific characteristics of movement of the user. The cleats may include differently configured first and second cleats. Each first cleat includes at least one first directional pattern and each second cleat includes at least one second directional pattern. Individual cleats and methods of assembling and designing a shoe are also provided.

26 Claims, 12 Drawing Sheets

(56) References Cited

U.S. PATENT DOCUMENTS

| | | | | |
|---|---|---|---|---|
| 5,724,754 | A | 3/1998 | Kataoka et al. | |
| D402,800 | S | 12/1998 | Santos et al. | |
| D412,240 | S | 7/1999 | Todd | |
| 5,943,794 | A | 8/1999 | Gelsomini | |
| 5,987,784 | A | 11/1999 | Bignell | |
| 6,018,893 | A * | 2/2000 | Workman | 36/134 |
| 6,209,230 | B1 | 4/2001 | Curley, Jr. | |
| D454,681 | S | 3/2002 | Duval | |
| 6,357,146 | B1 | 3/2002 | Wordsworth et al. | |
| 6,467,196 | B1 | 10/2002 | Koyama | |
| 6,598,324 | B1 | 7/2003 | Tsuji | |
| 6,601,042 | B1 | 7/2003 | Lyden | |
| 6,705,027 | B1 * | 3/2004 | Campbell | 36/127 |
| 6,813,847 | B2 | 11/2004 | Workman | |
| 6,834,446 | B2 | 12/2004 | McMullin | |
| 6,892,479 | B2 | 5/2005 | Auger et al. | |
| 6,904,707 | B2 | 6/2005 | McMullin | |
| D513,359 | S | 1/2006 | McMullin | |
| 7,007,410 | B2 | 3/2006 | Auger et al. | |
| 7,016,867 | B2 | 3/2006 | Lyden | |
| 7,086,183 | B2 | 8/2006 | Wood et al. | |
| 7,107,235 | B2 | 9/2006 | Lyden | |
| 7,249,427 | B2 | 7/2007 | Jungkind | |
| D564,739 | S | 3/2008 | Belley et al. | |
| 7,406,781 | B2 | 8/2008 | Scholz | |
| 7,428,790 | B2 | 9/2008 | Pellerin | |
| 7,441,350 | B2 | 10/2008 | Auger et al. | |
| 7,827,705 | B2 * | 11/2010 | Baucom et al. | 36/59 R |
| 8,219,461 | B2 | 7/2012 | Langvin | |
| 2007/0043630 | A1 | 2/2007 | Lyden | |
| 2007/0157489 | A1 | 7/2007 | Wu | 36/134 |
| 2012/0203659 | A1 | 8/2012 | Langvin | |

FOREIGN PATENT DOCUMENTS

| | | | | |
|---|---|---|---|---|
| GB | 2 223 394 | A | 4/1990 | A43C 15/00 |
| JP | 7275004 | A | 10/1995 | |

OTHER PUBLICATIONS

Written Opinion of the International Searching Authority, mailed Jun. 6, 2011.

The State Intellectual Property Office of The People's Republic of China, First Office Action dated May 30, 2014, pertaining to Application No. 201180005725.4, 15 pages.

The State Intellectual Property Office of The People's Republic of China, Second Office Action dated Mar. 20, 2015, pertaining to Application No. 201180005725.4, 5 pages (In Chinese).

The State Intellectual Property Office of The People's Republic of China, Second Office Action dated Mar. 20, 2015, pertaining to Application No. 201180005725.4, 5 pages (English Translation).

European Patent Office, Partial Supplementary European Search Report, International Application No. 11733305.4-1655, dated Dec. 1, 2014, 7 pages.

European Patent Office, Extended European Search Report—Application No. 11733305.4-1658 dated Jun. 19, 2015, 12 pages.

* cited by examiner

FOOTWEAR WITH ENHANCED CLEATS

CROSS-REFERENCE TO RELATED APPLICATIONS

This patent application claims the benefit of U.S. Provisional Patent Application No. 61/294,320, filed Jan. 12, 2010 and U.S. Provisional Patent Application No. 61/374,469, filed Aug. 17, 2010, both of which are incorporated by reference.

BACKGROUND

This patent disclosure generally relates to footwear and, more particularly, to athletic shoes with cleats thereon.

Athletes often use specialized footwear to enhance their performance. In a variety of sports, traction on a playing field is improved by wearing a spiked or cleated shoe. Cleat systems have evolved into two typical structures—cleats that are molded as part of the sole of a shoe and cleats that are detachable from the sole.

The detachable cleat systems typically permit an athlete to change the length of cleat on the shoe to account for the field conditions caused by weather and the type of turf, and the specific activity being performed on the turf. With regard to football, a standard seven studded detachable cleat system is typically used by most shoe manufacturers. Soccer typically uses a similar cleat system but has one fewer cleat.

Most sports utilize specific positions on the playing field that require the mastering of different skill sets. Football, baseball, soccer, lacrosse, field hockey, as well as many other sports, utilize positions or skill sets that rely on certain starting stances, movements, and other unique actions that vary from one position to the next. However, each of the athletes within a sport typically wears shoes that are configured in a similar, if not identical, manner. Accordingly, it is desirable to provide an enhanced athletic shoe that will take into consideration the specific needs of an athlete in order to improve his/her performance.

SUMMARY

A shoe with cleats is provided that includes a sole, a plurality of generally frusto-conical first cleats on the sole, and a plurality of generally frusto-conical second cleats on the sole. Each first cleat has a first cleat central axis and is rotationally asymmetrical about the first cleat central axis. Each second cleat has a second cleat central axis and is rotationally asymmetrical about the second cleat central axis. The first and second cleats are differently configured.

If desired, the sole may have a plurality of spaced apart cleat receiving receptacles for detachably mounting the cleats to the sole. Each cleat may include a central bore extending generally along the central cleat axis of the cleat and a fastening member extending through the bore and being removably secured to the sole. Each cleat may have a generally circular base with a base central axis and a generally circular end surface with an end surface central axis. The base and end surface central axes being generally coincident to define a cleat central axis. The cleats may be permanently mounted to the sole.

A shoe with cleats may be provided including a sole and a plurality of first and second cleats located on the sole. Each cleat may have a generally arcuate base generally adjacent the sole and a generally arcuate end surface spaced from the sole. The base is larger than the end surface and an outer generally arcuate engaging surface extends between the base and the end surface. The outer engaging surface includes a first directional pattern and a second directional pattern. The first directional pattern has at least one first recess and is generally symmetrically configured relative to a bisecting plane that extends through the base and the end surface of each cleat. The second directional pattern has at least one second recess and is generally symmetrically configured relative to the bisecting plane. The first and second recesses are differently shaped.

If desired, the first and second directional patterns may have different arcuate lengths extending around the outer generally arcuate engaging surface approximately midway between the base and the end surface. The sole may be generally elongated and have a longitudinal axis. The bisecting planes of the cleats may extend generally parallel to the longitudinal axis of the sole. Each cleat may have a central axis generally extending through both the arcuate base and the arcuate end surface with each cleat being asymmetrical about its central axis. Each cleat may includes central bore extending generally along its central axis and a fastening member may extend through the bore and be removably secured to the sole. The first recess may extend generally from the base to the end surface, the second recess may extend generally from the base to the end surface and the first and second recesses face in opposite directions. The bisecting plane of each cleat may define first and second cleat halves and the first and second cleat halves may be a mirror image of each other. The sole may have a plurality of spaced apart cleat receiving receptacles for detachably mounting the cleats to the sole. The cleats may be permanently mounted to the sole.

A shoe with cleats may be provided including a sole having a plurality of cleats thereon at spaced apart locations and each cleat having a base generally adjacent the sole and an end surface spaced from the sole. The path between the base and the end surface define a cleat envelope between the base and the end surface. Each cleat is chosen from a group including a first set of first cleats and a second set of second cleats. The first set of first cleats is configured differently from the second set of second cleats and each first cleat includes at least one first directional pattern in the cleat envelope thereof and each second cleat includes at least one second directional pattern in the cleat envelope thereof.

If desired, each cleat may have a central axis generally extending through both the base and the end surface and each cleat may be asymmetrical about its central axis. Each cleat may have a bisecting plane and be generally symmetrically configured relative to the bisecting plane. The first directional pattern may include at least one first recess and the second directional pattern may include at least one second recess with the first and second recesses being differently shaped. The cleats may be permanently mounted to the sole. The sole may have a plurality of spaced apart cleat receiving receptacles for detachably mounting the cleats to the sole A cleat for use with an athletic shoe may include a generally circular base with a first central axis and a generally circular end surface spaced from and generally parallel to the base. A rigid engaging surface may extend between the base and the end surface with the rigid engaging surface being rotationally asymmetrical about the first central axis.

If desired, the engaging surface may be generally frusto-conical shaped. The end surface may have a second central axis and the first and second central axes may be generally coincident. A central bore may extend generally along the first and second central cleat axes and be configured to removably receive a fastening device therethrough for mounting the cleat on the shoe. The cleat may further include a visual indicator to assist in orienting the cleat when mounting the cleat on the shoe. The cleat may be generally symmetrically configured relative to a bisecting plane extending through the base and the end surface. The rigid engaging surface may include first and second recesses generally facing in opposite directions and the bisecting plane may divide the first and second recesses generally in half. Each of the first and second recesses may extend at least approximately 110° about the first central axis. The first recess may extend at least approximately 140° around the first central axis. At least one projection may be provided that extends from the first recess. The projection may be generally aligned with the bisecting plane. The first and second recesses may slope from the base to the end surface at different rates. Additional recesses may be provided that open generally laterally relative to the bisecting plane. The rigid engaging surface may include first and second differently configured directional patterns. The first directional pattern may include two, spaced apart first recesses, the first recesses being located on opposite sides of a bisecting plane extending through the base and the end surface. At least one projection may be provided that extends from the cleat and is generally aligned with the bisecting plane. The first directional pattern may extend at least approximately 110° around the first central axis. The first directional pattern may include at least two pockets therein. The first directional pattern may include at least two projections therein. The second directional pattern may include two, spaced apart second recesses with the second recesses being located on opposite sides of the bisecting plane.

A cleat may include a generally circular base having a first central axis and a generally circular end surface spaced from and smaller than the base. An engaging surface may extend between the base and the end surface with the engaging surface having a first arcuate segment extending generally along a first portion generally adjacent the base and a second arcuate segment extending generally along a second portion generally adjacent the base and spaced from the first portion. The first arcuate segment defines a first radius relative to the first central axis and the second arcuate segment defines a second radius relative to the first central axis with the first radius being greater than the second radius.

If desired, the first arcuate segment may have a greater circumferential length than the second arcuate segment. The engaging surface may include a first directional pattern aligned with the first arcuate segment and a second directional pattern aligned with the second arcuate segment. The first directional pattern may include a first recess, the second directional pattern may include a second recess and the first and second recesses may slope from the base to the end surface at different rates. The end surface may have a second central axis with the first and second central axes being generally coincident. A central bore may extend generally along the first and second central cleat axes and be configured to removably receive a fastening device therethrough. The cleat may be generally symmetrically configured relative to a bisecting plane extending through the base and the end surface. The engaging surface may include first and second recesses generally facing in opposite directions and the bisecting plane may divide the first and second recesses generally in half.

A cleat for use with an athletic shoe may include a generally circular base, and a generally circular end surface spaced from the base with the base being larger than the end surface. An outer arcuate engaging surface may extend between the base and the end surface. The outer engaging surface may include a first directional pattern including at least one first recess and a second directional pattern including at least one second recess. The first and second recesses are differently shaped with the first directional pattern extending along an arc of the arcuate engaging surface and being generally symmetrically configured relative to a bisecting plane that extends through the base and the end surface of the cleat. The second directional pattern extends along another arc of the arcuate engaging surface and is generally symmetrically configured relative to the bisecting plane.

If desired, each of the first and second recesses may extend at least approximately 110° around a central axis of the cleat. The first recess extends at least approximately 140° around a central axis of the cleat. At least one projection may also be provided that extends from the first recess and is generally aligned with the bisecting plane. The first and second recesses may slope from the base to the end surface at different rates. The second directional pattern may include two, spaced apart second recesses with the second recesses being located on opposite sides of the bisecting plane. At least one projection may also be provided that extends from the cleat and is located circumferentially between the second recesses and aligned with the bisecting plane. Additional recesses may be provided that open generally laterally relative to the bisecting plane.

A method of assembling an athletic shoe with removable cleats may include providing a shoe having a sole with a plurality of mounting receptacles at spaced apart locations. At least first and second sets of differently configured generally frusto-conical cleats may be provided with each cleat having a central cleat axis and being rotationally asymmetrical about its central axis. One of the cleats from the first and second sets of cleats is selected and mounted at one of the mounting receptacles. The selecting and mounting steps are repeated until a cleat has been mounted at each of the mounting receptacles.

If desired, the selecting step may be performed based upon desired performance characteristics of the shoe. The selecting step may be performed based upon desired performance characteristics of each region of the shoe. The desired performance characteristics of different regions of the sole may also be determined. A third set of differently configured generally frusto-conical cleats may be provided and the selecting step may include selecting from the first, second and third sets of cleats. Each cleat may also be angularly oriented prior to the mounting step and such angular orientation maintained during the mounting step.

A method of assembling an athletic shoe with removable cleats may include providing a shoe having a sole with a plurality of mounting receptacles at spaced apart locations. At least first and second sets of differently configured cleats are provided Desired shoe performance characteristics are determined based upon generalized, predominant movements of a specific position within an athletic endeavor. One of the cleats from the first and second sets of cleats is selected based upon the desired shoe performance characteristics and mounted at one of the mounting receptacles. The selecting and mounting steps are repeated until a cleat has been mounted at each of the mounting receptacles.

If desired, the determining step may include determining desired performance characteristics of each region of the shoe. A bisecting plane through each cleat may divide the cleat into first and second halves and the first and second haves may be generally symmetrically configured relative to the bisecting plane. A third set of differently configured cleats may be provided and the selecting step may include selecting from the first, second and third sets of cleats. Each cleat may be angularly oriented prior to the mounting step and such angular orientation maintained during the mounting step.

A method of designing an athletic shoe with cleats may include determining desired shoe performance characteristics based upon generalized, predominant movements of a specific position within an athletic endeavor and determining a plurality of spaced apart cleat locations on a sole of a shoe. At least first and second differently configured cleat designs are provided. One of the cleat designs is selected for a selected cleat location and the selecting step is repeated until a cleat design has been chosen for each cleat location.

If desired, the selecting step may be performed based upon desired performance characteristics of the shoe. The selecting step may be performed based upon desired performance characteristics of each region of the shoe. The desired performance characteristics of different regions of the sole may be determined. A third set of differently configured generally frusto-conical cleats may be provided and the selecting step may include selecting from the first, second and third sets of cleats. The selecting step may include selecting the first cleat design for a first cleat location and selecting the second cleat design for a second cleat location. The selecting step may include selecting the first cleat design for each of the cleat locations.

BRIEF DESCRIPTION OF THE DRAWINGS

Various other objects, features and attendant advantages will become more fully appreciated as the same become better understood when considered in conjunction with the accompanying drawings in which like reference numbers designate the same or similar parts throughout the several views, and in which.

DETAILED DESCRIPTION OF THE ILLUSTRATED EMBODIMENTS

The following description is intended to convey the operation of exemplary embodiments of the invention to those skilled in the art. It will be appreciated that this description is intended to aid the reader, not to limit the invention. As such, references to a feature or aspect disclosed herein are intended to describe a feature or aspect of an embodiment of the invention, not to imply that every embodiment of the invention must have the described characteristic. Furthermore, it should be noted that the depicted detailed description illustrates a number of features. While certain features have been combined together to illustrate potential designs, those features may also be used in other combinations not expressly disclosed. Thus, the depicted combinations are not intended to be limiting unless otherwise noted.

Figure 1:
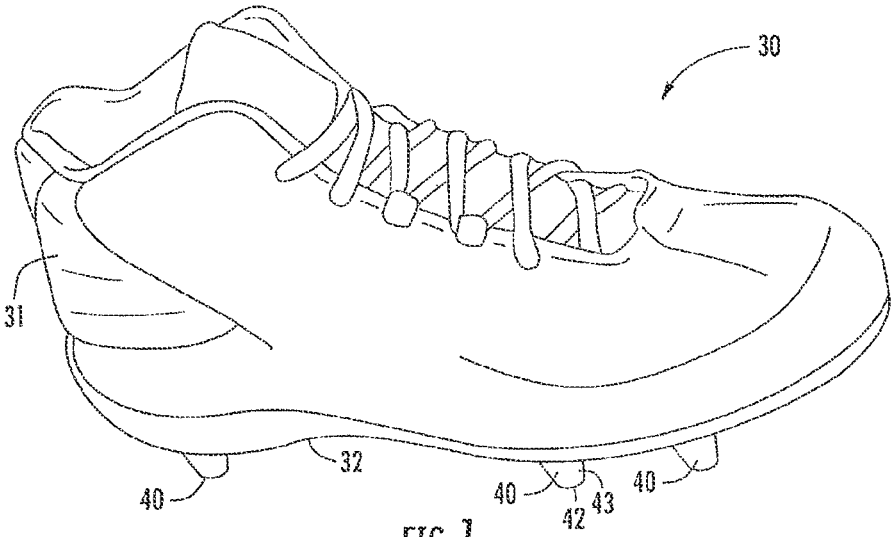
FIG. 1 is a perspective view of a shoe including removable cleats.
Figure 2:
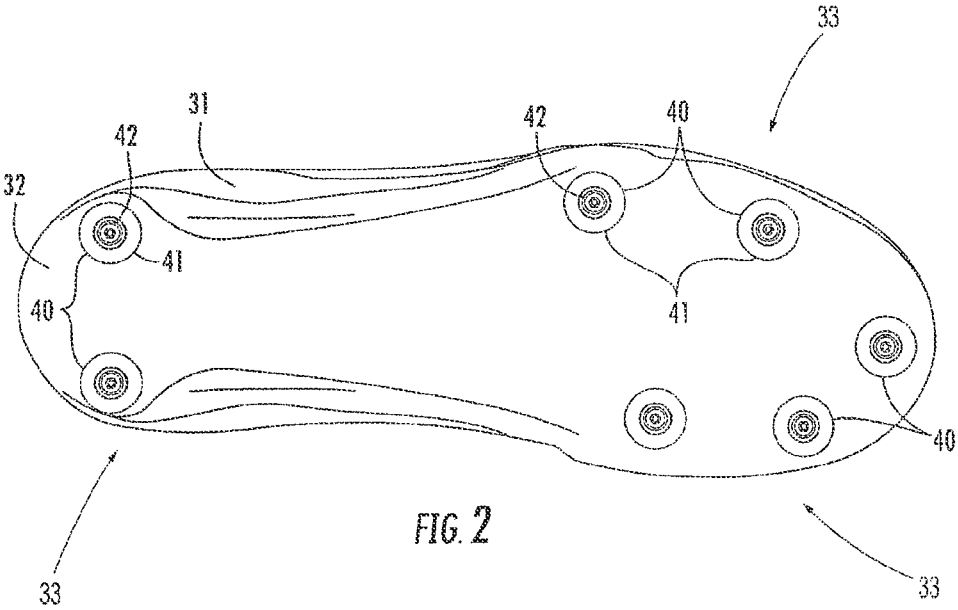
FIG. 2 is a bottom plan view of the shoe of FIG. 1 with the cleats depicted in a generic manner.

FIGS. 1-2 depict an athletic shoe 30 with a cleat system in which the individual cleats 40 may be chosen from sets of differently configured cleats in order to customize the shoe to specific desired performance characteristics. More specifically, shoe 30 may be customized for the skill set generally used by athletes playing a specific position, the specific needs or desires of an individual athlete, and may also compensate for field conditions encountered on a particular day. For example, when playing football, the type and direction of movements of an offensive lineman is typically substantially different from the typical movements of a running back and both are substantially different from the typical movements of a defensive back. Similarly, athletes playing other turf sports such as soccer, lacrosse, rugby and field hockey have different needs and desires based upon the position they play and their individual style. Shoe 30 permits the use of a desired traction pattern to optimize or "tune" the characteristics of the shoe based upon the position, skill set or desires of the athlete and the field conditions encountered in order to improve the performance of the athlete or otherwise improve the performance of the shoe.

Figure 3:
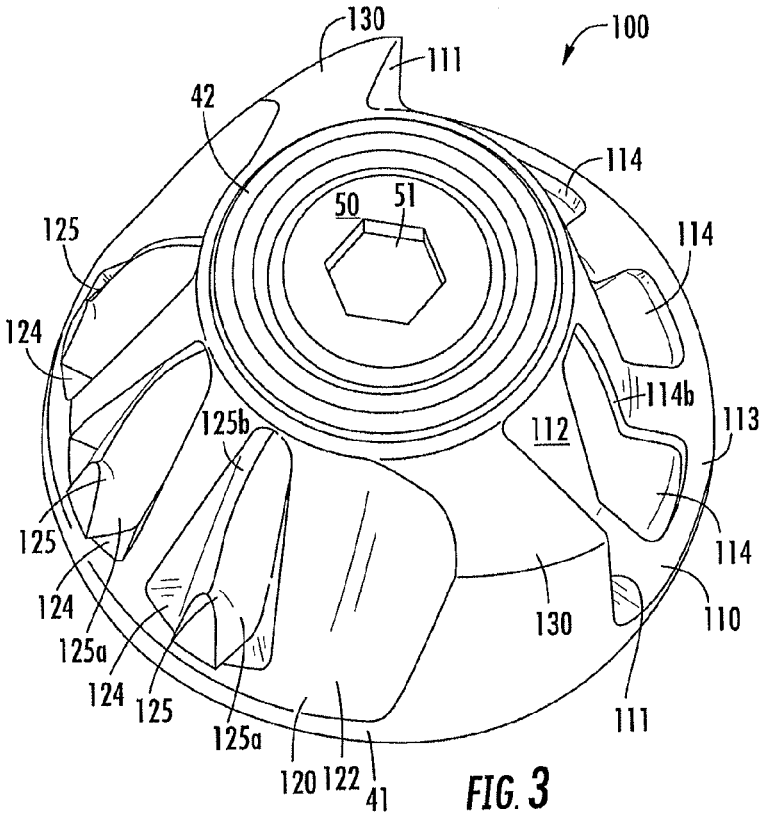
FIG. 3 is a front perspective view of a first embodiment of a cleat having a plurality of directional patterns with the cleat oriented in an upside down manner.

Shoe 30 includes an upper 31 attached to a sole 32 to which the cleats 40 are removably attached. The sole 32 includes a plurality of threaded mounting locations 33 at which the individual cleats may be removably fastened. By providing cleats of different configurations, different functionality maybe provided at different regions of the sole 32 and each shoe may include cleats specifically selected for the skill set or position of the athlete wearing the shoe. Each cleat 40 is generally conical in shape with the lower end (as viewed in FIG. 1) cut off or truncated in order to form a generally frusto-conical shape. As such, cleat 40 includes a generally circular base 41 for positioning adjacent sole 32 and a generally circular end surface 42 at an end opposite the base 41. A generally frusto-conically shaped turf engaging surface 43 extends between base 41 and end surface 42 and includes various recesses and projections as described below. A central stepped bore 44 (FIG. 7) having a central axis 45 extends through the cleat and a mounting screw 50 (FIG. 3) is inserted in the central bore and into the aperture at each mounting location 33 in sole 32 in order to secure the cleat 40 to shoe 30. In one embodiment, cleat 40 is made of a plastic material or polymer such as nylon but could also be made of other materials and may include a composite structure such as multiple plastic components or a plastic body and a metal tip as part of end surface 42. The nylon material may be sufficiently rigid in order to prevent significant deformation of the cleats and increase their life.

It should be noted that in this description, representations of directions such as up, down, left, right, front, forward, rear, rearward, and the like, used for explaining the structure and movement of each part of the disclosed embodiments are not intended to be absolute, but rather are relative. These representations are appropriate when each part of the disclosed embodiments is in the position shown in the figures. If the position or frame of reference of the disclosed embodiments changes, however, these representations are to be changed according to the change in the position or frame of reference of the disclosed embodiments.

Cleats 40 are depicted in FIGS. 1-2 in a generic form and, as described below, may be configured in a variety of different shapes depending upon the desired performance at that specific cleat location on the shoe. Each of the cleats disclosed below is an embodiment of cleat 40 having various directional patterns formed of different recesses, pockets, ribs and projections to give each cleat unique performance characteristics. The path between base 41 and end surface 42 defines an envelope and the outer or turf engaging surface of the cleats include recesses, pockets, ribs and projections that extend into or out of the envelope to define the different directional patterns. By combining the different cleats in different manners on sole 32, significant customization of performance of the shoe 30 may be achieved. Like reference numbers are used to identify like elements in the various cleats and duplicate descriptions of such common elements are omitted.

Figure 4:
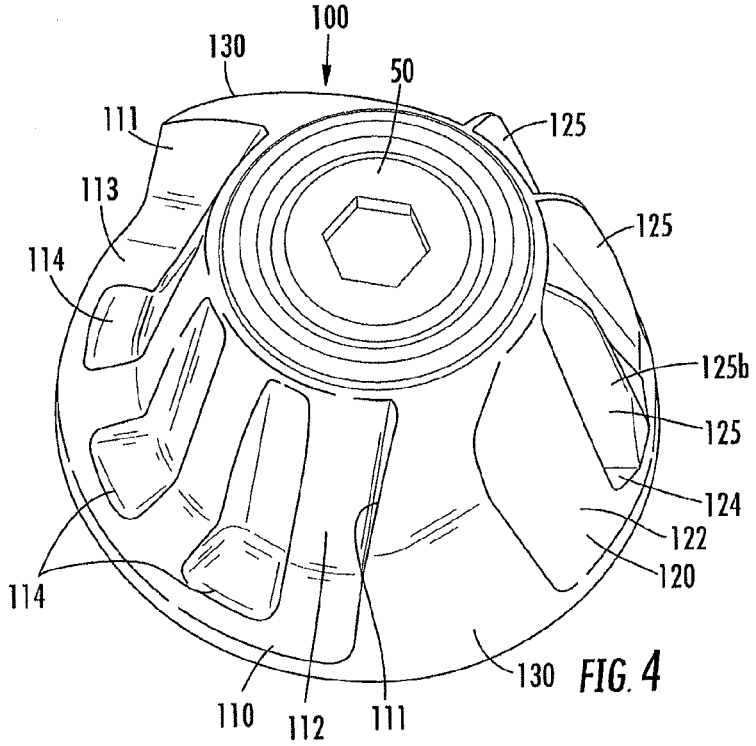
FIG. 4 is a rear perspective view of the cleat of FIG. 3.
Figure 5:
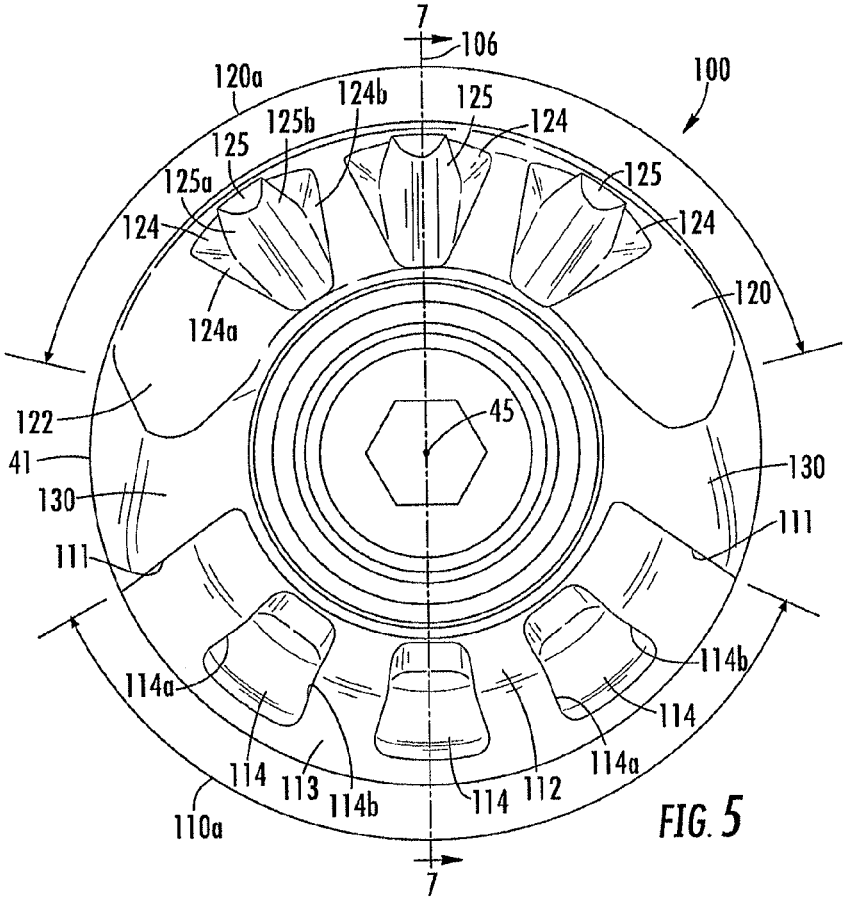
FIG. 5 is a top plan view of the cleat of FIG. 3.

Referring to FIGS. 3-7, a first embodiment of the improved cleat 100 is depicted. The cleat 100 is generally frusto-conically shaped with central bore 44 for receiving screw 50 or other fastening mechanism. Cleat 100 has a relatively deep generally rearwardly facing directional pattern in the form of an arc-shaped recess 110 and a shallow generally forwardly facing directional pattern in the form of an arc-shaped recess 120. Each recess 110, 120 extends generally vertically from adjacent generally circular base 41 to generally circular end surface 42. Referring to FIG. 5, rearwardly facing recess 110 extends around central axis 45 of cleat 100 along an arc 110*a* of approximately 135 degrees and is symmetrically positioned relative to or bisected by centerline 106 of cleat 100 such that half of the rearwardly facing recess 110 is located on each side of the centerline.

The lateral or end walls 111 of rearwardly facing recess 110 define the circumferential limits or boundary of recess 110. The forward wall of recess 110 is formed by arcuate sloped surface 112 that extends downward generally from an edge of circular end surface 42 of cleat 100 in a relatively steep manner down to a flange 113 to create a lower surface of the rearwardly facing recess 110. Three pockets 114 are generally evenly spaced within recess 110 and are formed as additional recesses in the arcuate sloped surface 112 and the flange 113 (FIG. 4). The central pocket is positioned along centerline 106 and the outer two pockets 114 are positioned on opposite sides of the central pocket and spaced from end walls 111 of recess 110. Pockets 114 include lateral sidewalls 114*a*, 114*b*.

Figure 7:
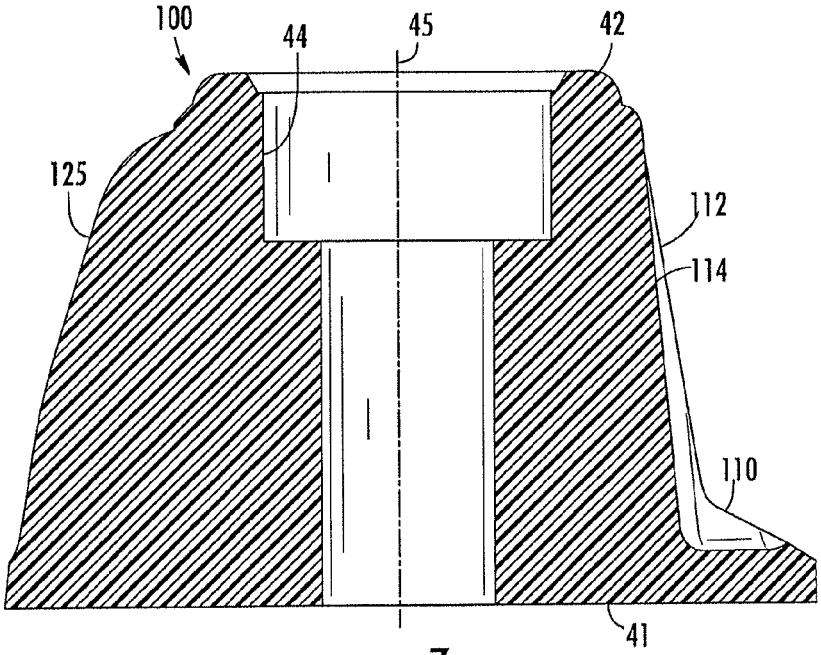
FIG. 7 is a section taken generally along line 7-7 of FIG. 5.

Forward recess 120 extends along a circumferential arc 120*a* adjacent the front or forward edge of cleat 100 approximately 170 degrees around central axis 45 and is bisected by centerline 106 of cleat 100. Forward recess 120 extends downward generally from circular end surface 42 to circular base 41 along arcuate sloped surface 122 in a less steep or shallower manner than the slope of the arcuate sloped surface 112 of rearwardly facing recess 110. In other words, as best seen in FIG. 7, the radius adjacent base 41 at forward recess 120 is greater than the radius adjacent base 41 at rear recess 110. Forward recess 120 includes three smaller recesses 124, each having a forwardly facing rib or projection 125 extending therefrom. The center recess 124 and its rib 125 are positioned along centerline 106 so as to be aligned with and facing in a diametrically opposite direction relative to the central pocket 114 of recess 110. Similarly, the other recesses 124 and their respective ribs 125 are diametrically aligned with the pockets 114 of recess 110. Each recess 124 includes lateral sidewalls 124*a*, 124*b* and ribs 125 include oppositely facing side surfaces 125*a*, 125*b*.

Figure 6:
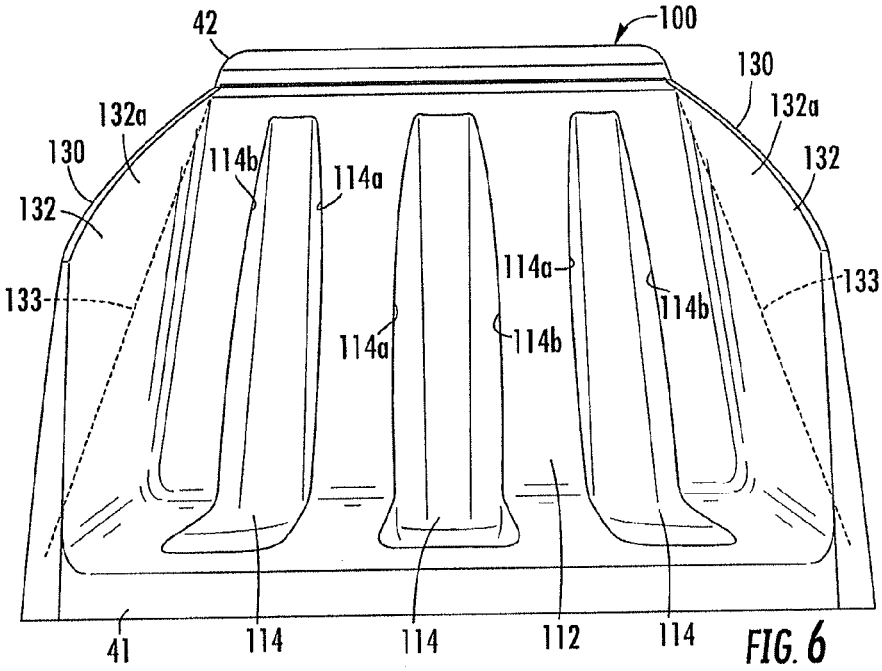
FIG. 6 is a rear view of the cleat of FIG. 3.

A dividing wall 130 is located between the ends of rearwardly facing recess 110 and forwardly facing recess 120. The rear edges of walls 130 are defined by the lateral or end walls 111 of rearwardly facing recess 110. Lateral walls 111 extend generally laterally or away from centerline 106 and are also sloped somewhat rearwardly (or downwardly as viewed in FIG. 5) at an angle of approximately 40 degrees relative to centerline 106. Referring to FIG. 6, wall 130 includes an upper section 132 that extends beyond an imaginary line or path 133 connecting base 41 to end surface 42. Additional surface area 132*a* of upper section 132 of wall 130 is provided in order to increase the surface area engaged by the turf generally in a forward manner in order to enhance traction when an athlete moves in the forward direction.

The recesses, pockets, projections and walls of cleat 100 create additional surfaces to provide additional surface area for engagement with the turf in various directions as the cleat 100 engages the turf and the athlete pushes off to move in the desired direction. More specifically, the lateral walls 111 formed at the intersection of wall 130 and rearwardly facing recess 110 create angled surfaces relative to centerline 106. Sloped surface 112 generally creates a rearwardly facing surface but due to its arcuate nature, also creates an engagement surface or series of engagement sections that are at an angle to centerline 106. The lateral sidewalls 114*a*, 114*b* of pockets 114 likewise create engagement surfaces at an angle to lateral centerline 106. Forwardly facing recess 120 creates a generally forwardly facing surface that, due to its arcuate nature, also creates a surface having aspects that are at an angle to centerline 106. Each of the lateral sidewalls 124*a*, 124*b* of recesses 124 together with the oppositely facing side surfaces 125*a*, 125*b* of ribs 125 also create surfaces that are at an angle to centerline 106. The reduced material at rearwardly facing recess 110 and forwardly facing recess 120 reduces the amount of surface area of the cleat that is available to engage the turf in a lateral manner (i.e., at an angle to centerline 106) and therefore these additional features are provided in order to compensate for such reduced surface area by providing addition surface area for engagement in a lateral manner. In other words, recesses 110, 120 create additional surface area to enhance traction in a desired direction, namely, in the forward and rearward directions. In doing so, the surface area in the lateral directions (transverse to centerline 106) is somewhat reduced and the additional recesses and projections are provided to compensate for such reduction. Fewer or greater numbers of the smaller recesses, pockets, projections and ribs could be utilized depending on the desired performance characteristics.

Referring to FIG. 7, the arcuate sloped surface 112 of rearwardly facing recess 110 is relatively steep so as to be almost generally perpendicular to base 41 (and thus to the turf) which will increase traction when the athlete is moving forward. The forwardly facing recess 120 is less steeply sloped in order to enhance an athlete's ability to move backwards since the motion utilized to move backwards typically includes pointing the athlete's toes relatively downward. The slope of the arcuate sloped surface 122 as well as the shape of ribs 125 permit cleat 100 to engage and penetrate the turf in an effective manner while the athlete is moving backwards generally along centerline 106.

As best seen in FIG. 5, cleat 100 is symmetrical about centerline 106 and is also rotationally asymmetrical about the central axis 45. In other words, the cleat is symmetrical in that if the cleat 100 were cut in half along centerline 106, the two halves would be mirror-images of each other. However, the cleat is rotationally asymmetrical because one cannot divide the cleat into any number of equal arcs about central axis 45 that are symmetrical about the central axis. That is, cutting the cleat into any number of equal arc length segments will not result in identically shaped arcuate segments.

As depicted, screw 50 is a hex socket head screw which includes a hex-shaped recess 51 into which a hex key or wrench (not shown) or other similar tool may be inserted in order to rotate screw 50 and mount cleat 40 to the sole 32 of the shoe. Alternative fasteners could be utilized such as ones having a TORX® drive system. Projections (not shown) or other registration structure may be provided between the cleats and sole so that the cleats 40 will remain in a desired orientation or registration position once screw 50 has been tightened. For example, one or more projections on the cleat may interact with one or more recesses on the sole to assist in maintaining the cleats in their desired orientation. In another embodiment, the mounting receptacles may be configured or adjustable to permit proper orientation of the cleats 40. If desired, a visual indicator such as a notch, a projection or a colored mark could be located on the outer surface of the cleat to simplify the desired alignment of the cleat.

Figure 8:
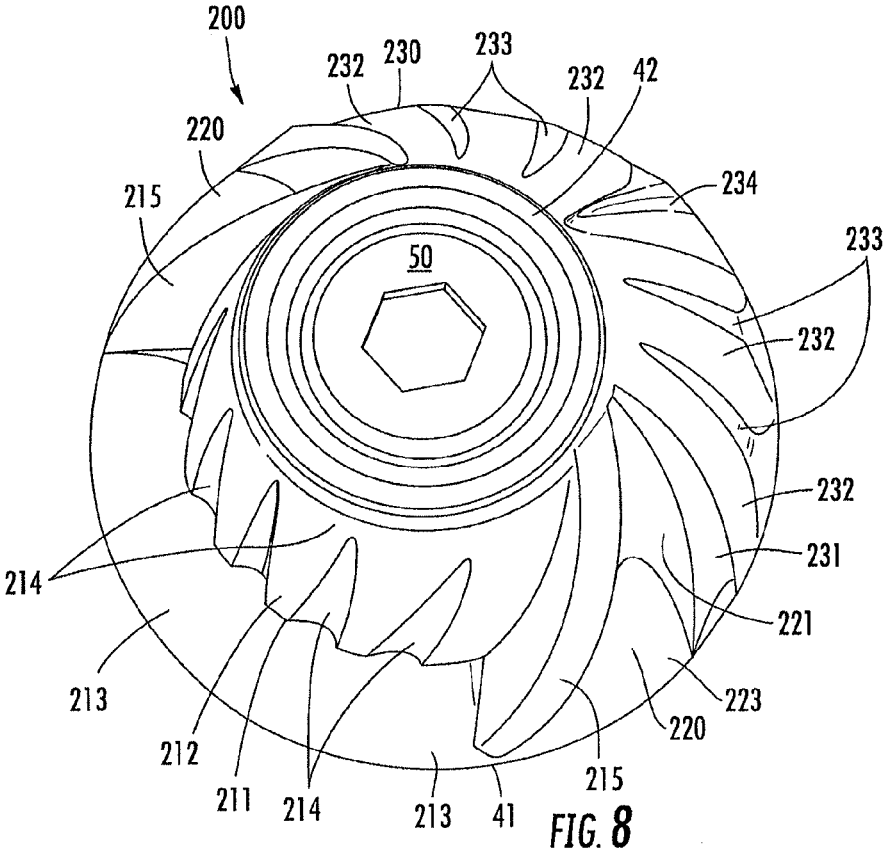
FIG. 8 is a rear perspective view of a second embodiment of a cleat having a plurality of directional patterns with the cleat oriented in an upside down manner.
Figure 9:
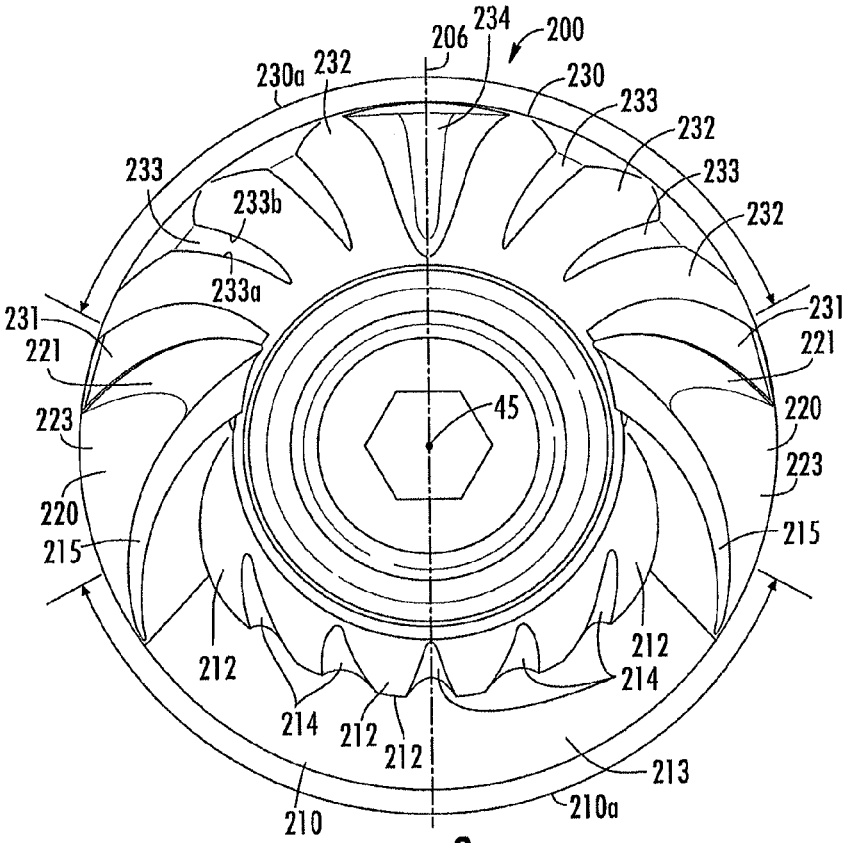
FIG. 9 is a top plan view of the cleat of FIG. 8.
Figure 10:
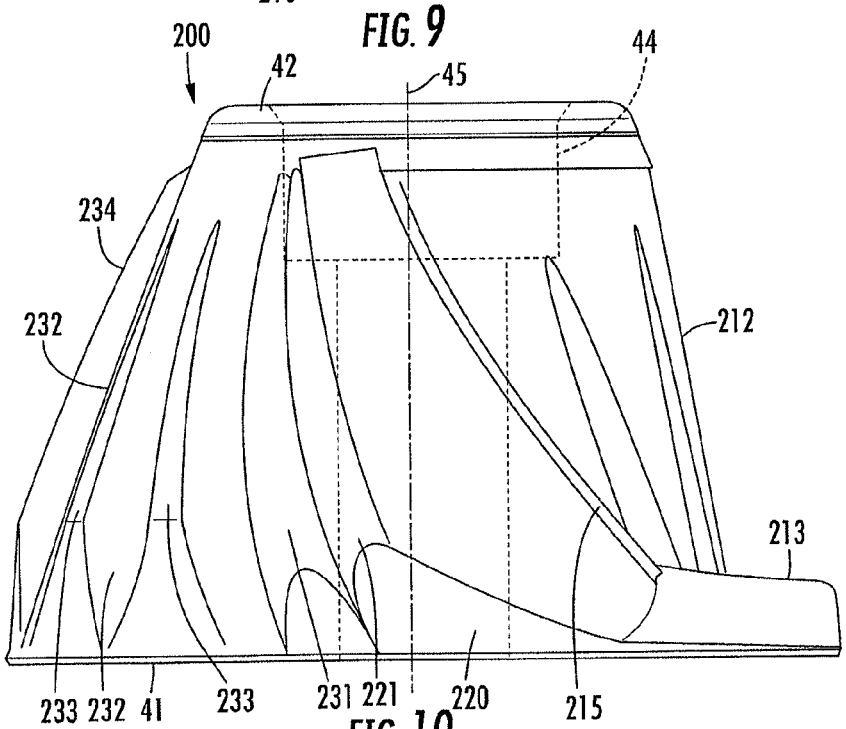
FIG. 10 is a side view of the cleat of FIG. 8.
Figure 11:
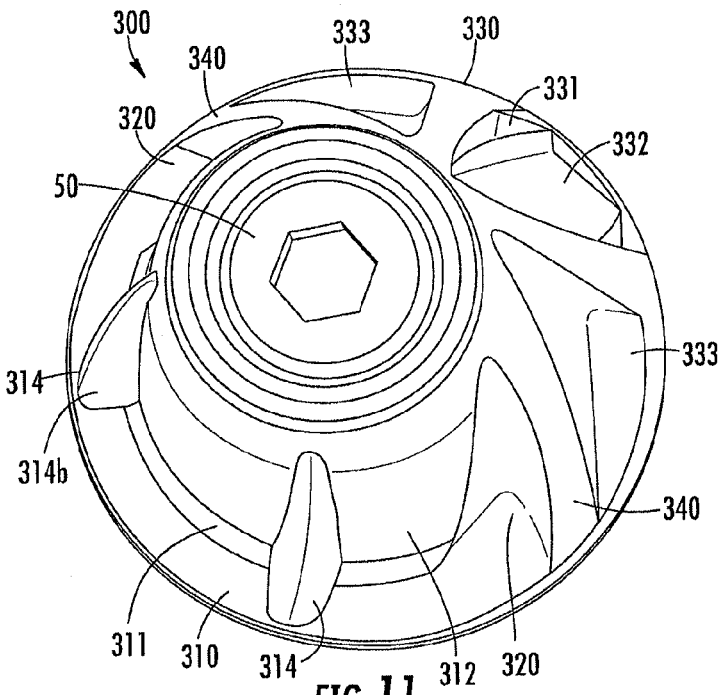
FIG. 11 is a rear perspective view of a third embodiment of a cleat having a plurality of directional patterns with the cleat oriented in an upside down manner.
Figure 12:
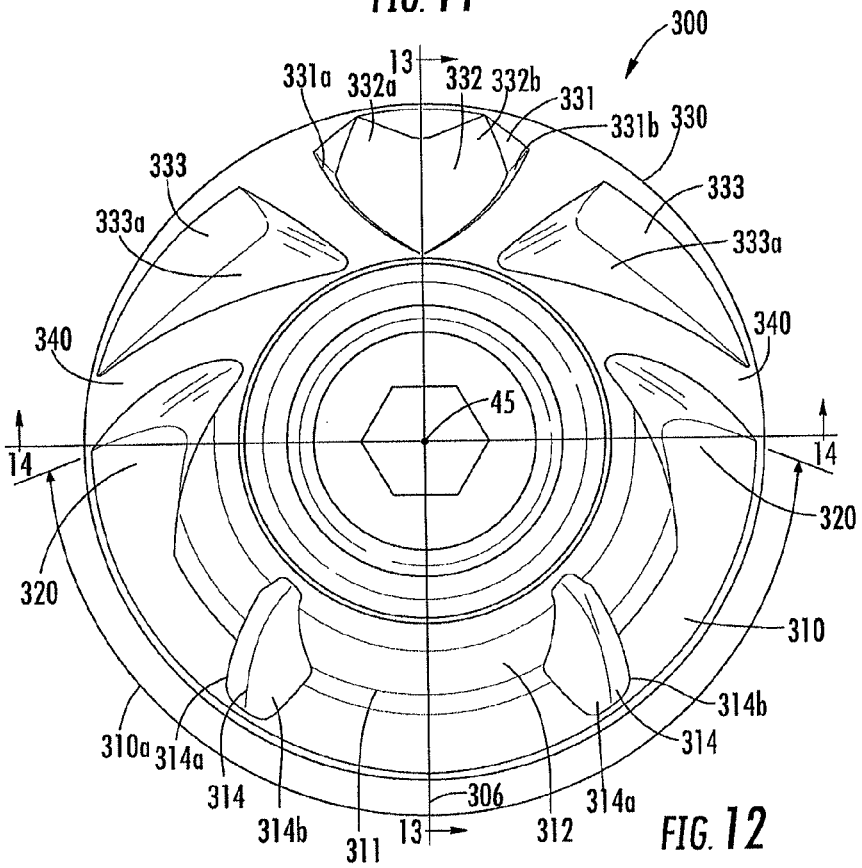
FIG. 12 is a top plan view of the cleat of FIG. 11.
Figure 13:
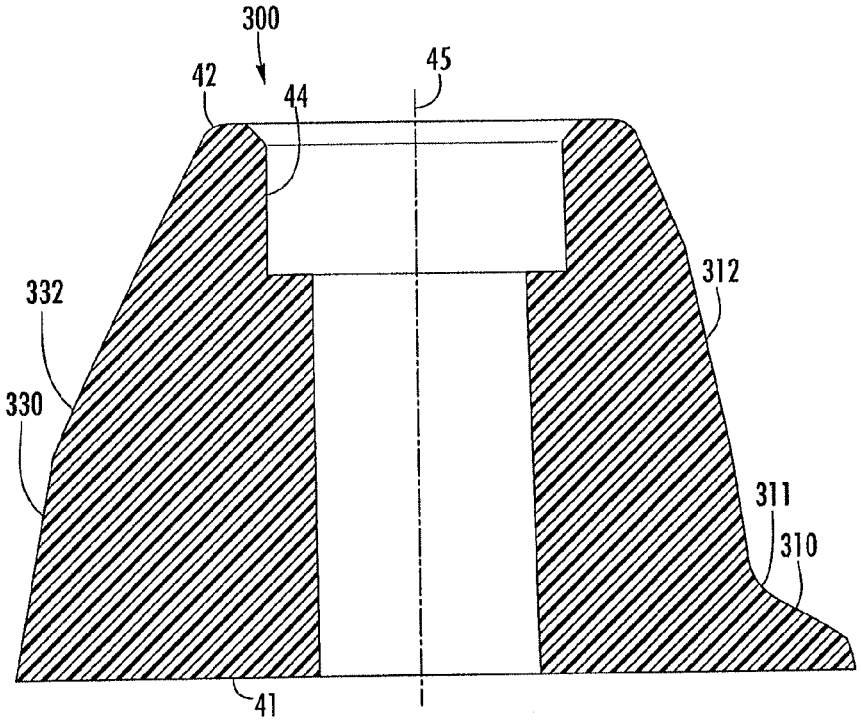
FIG. 13 is a section taken generally along line 13-13 of FIG. 12.
Figure 14:
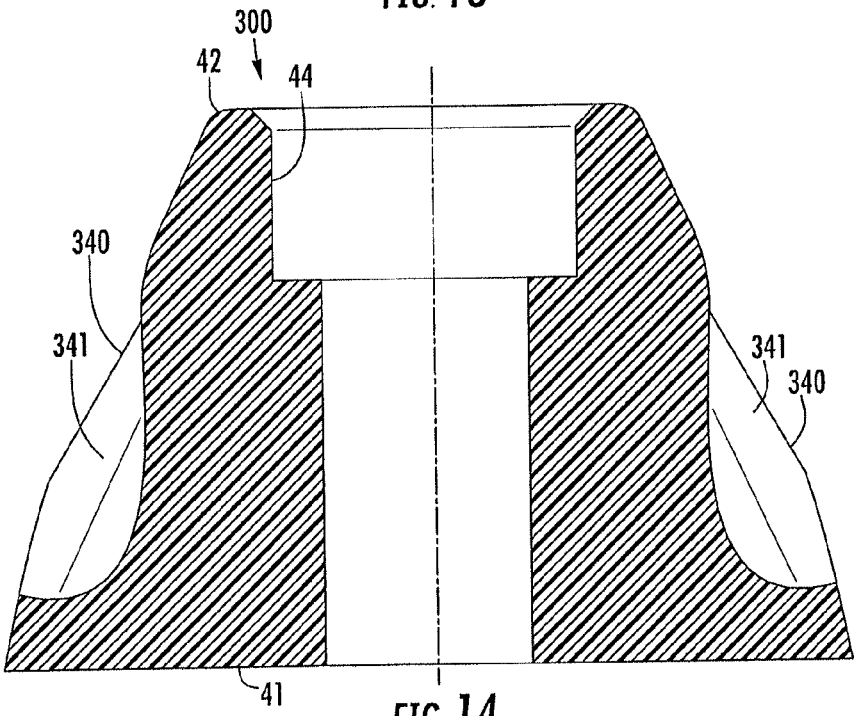
FIG. 14 is a section taken generally along line 14-14 of FIG. 12.
Figure 15:
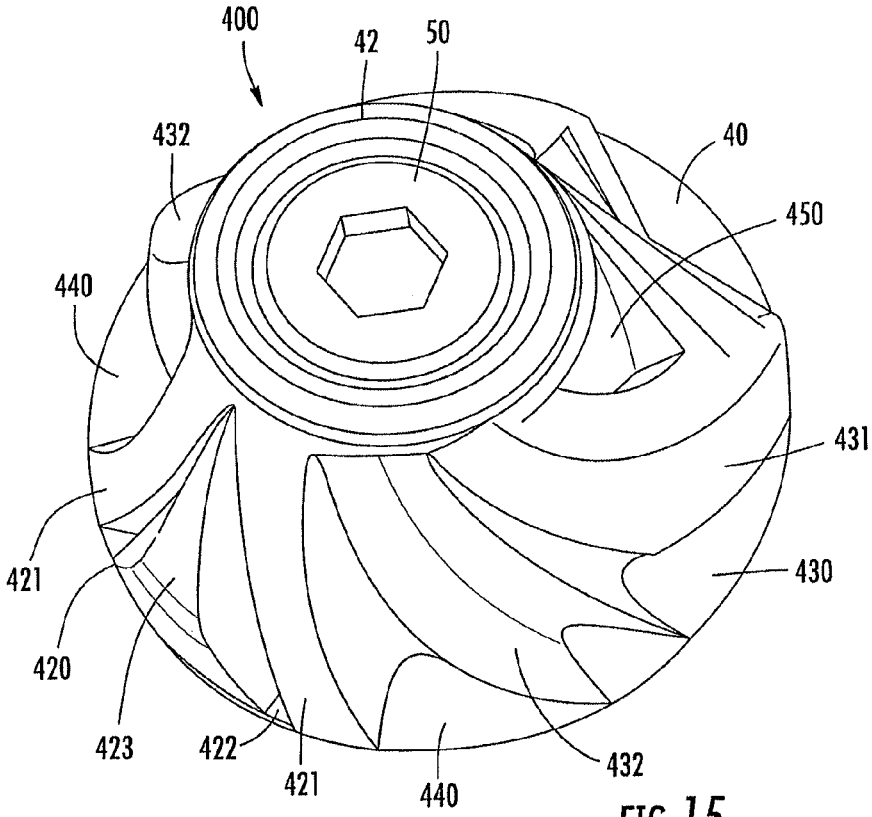
FIG. 15 is a front perspective view of a fourth embodiment of a cleat having a plurality of directional patterns with the cleat oriented in an upside down manner.
Figure 16:
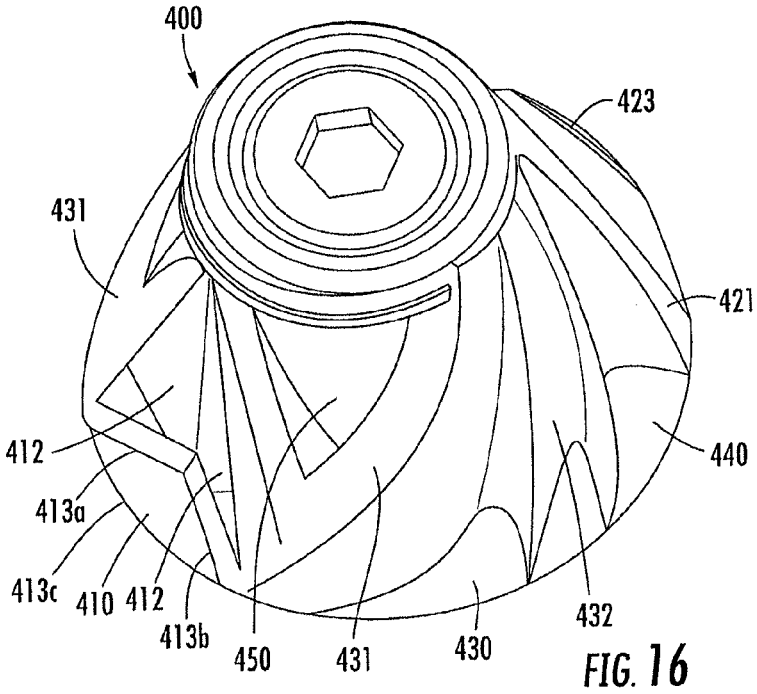
FIG. 16 is a rear perspective view of the cleat of FIG. 15.
Figure 17:
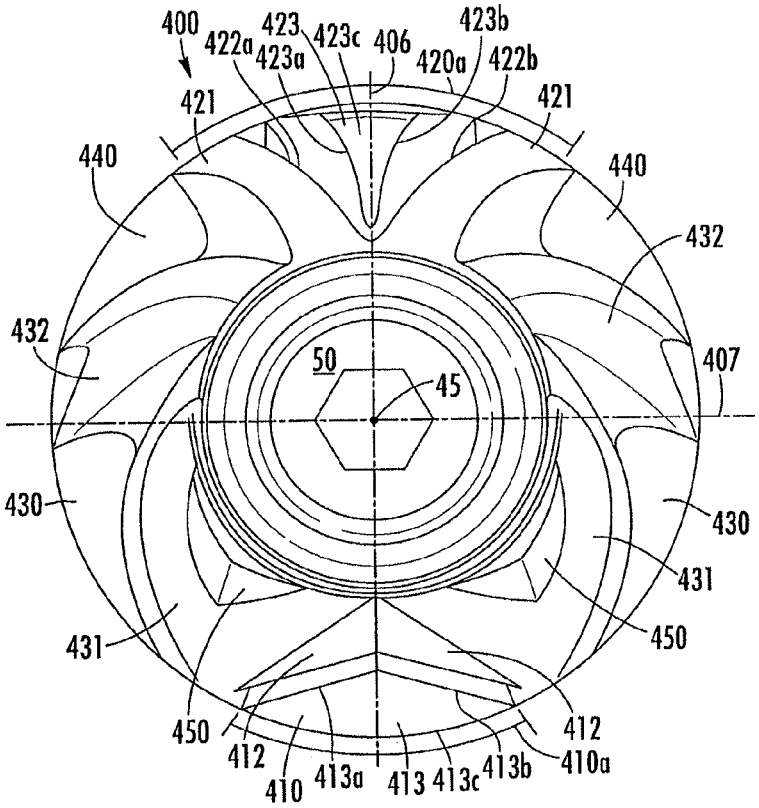
FIG. 17 is a top plan view of the cleat of FIG. 15.
Figure 18:
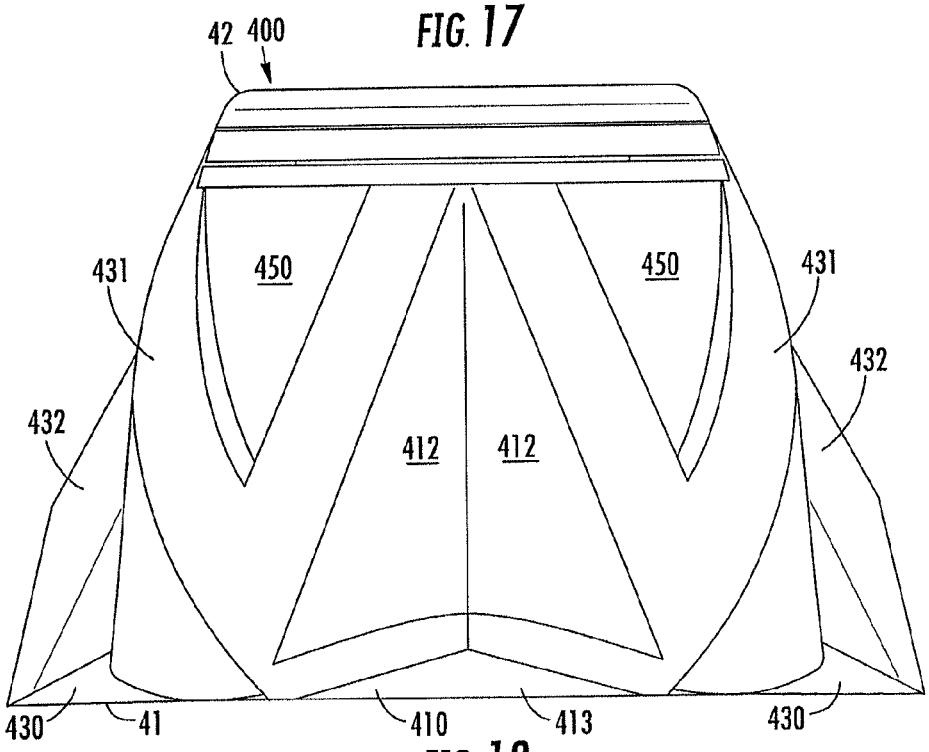
FIG. 18 is a rear view of the cleat of FIG. 15.
Figure 19:
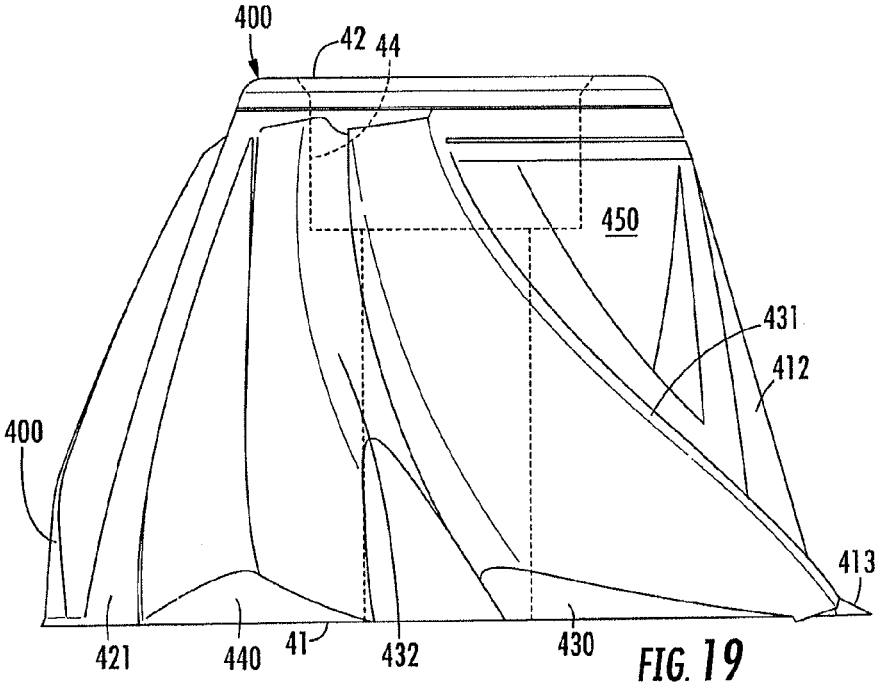
FIG. 19 is a side view of the cleat of FIG. 15.

FIGS. 8-10 depict another embodiment of an improved cleat 200. Cleat 200 includes a rearwardly facing directional pattern in the form of an arc-shaped recess 210 and a pair of oppositely facing laterally extending or opening (relative to centerline 206) recesses 220. Arc-shaped forwardly facing directional pattern 230 in the form of a series of recesses and ribs extends circumferentially between and forwardly of laterally extending recesses 220. Together, the lateral recesses 220 may be considered a third directional pattern that is symmetrical about the centerline 206.

The rearwardly facing arc-shaped recess 210 extends generally vertically from generally circular base 41 to generally circular end surface 42. Arcuate sloped surface 212 extends from end surface 42 to inner arcuate edge 211 which is spaced inward from an edge of base 41 along flange 213. Recess 210 extends along a circumferential arc 210*a* adjacent the rear edge of cleat 200 approximately 110 degrees about the central axis 45 and is bisected by centerline 206 so that half of the recess 210 is on each side of centerline 206. The ends of recess 210 are defined by lateral or end walls 215 that are somewhat arcuate or vane-shaped. As depicted, recess 210 includes five pockets or recesses in the arcuate sloped surface 212 with the center pocket positioned along centerline 206.

Laterally extending recesses 220 are shaped as somewhat arcuate triangular openings extending generally vertically from base 41 to end surface 42. The rearward edges of recesses 220 are defined by the lateral or end walls 215 of recess 210 and the forward edges of recesses 220 are defined by the rearward edge 231 of forward directional pattern 230. Each laterally extending recess 220 includes an inner sloped surface 221 that is relatively steep so that flange 223 extends radially inward along base 41 approximately the same amount as flange 213.

Forward directional pattern 230 includes an arcuate sloped surface 232 extending circumferentially between its rearward edges 231 and along an arc of approximately 160 degrees. As with rearwardly facing recess 210, pattern 230 is bisected by centerline 206 so that half is located on each side of the centerline. Arcuate sloped surface 232 is relatively shallow in that it slopes generally directly from the outer edge of base 41 to end surface 42 (FIG. 10). As depicted, a central rib 234 is positioned along centerline 206 and a pair of forward recesses 233 are spaced apart on each side of rib 234 along the forward directional pattern 230 with one aligned with each of the rearwardly facing pockets 214. Each of the forward recesses 233 includes lateral edges 233*a*, 233*b* as well a generally forwardly facing flat surface 233*c*. Other numbers of pockets and recesses could be used, if desired.

The rearwardly facing recess 210 includes a relatively steep arcuate surface 212 as well as lateral walls 215 in order to provide increased surface area to enhance traction in the forward direction along centerline 206. The laterally extending recesses 220 and the walls defining such recesses create a surface for engaging the turf in order to assist in moving laterally but still also generally enhancing movement in the forward direction. The forward directional pattern 230 including forward recesses 233 and rib 234 enhance the cleat's ability to enter the turf and the various surfaces 233*a*, 233*b*, 233*c* of recesses 233 and the surfaces 214*a*, 214*b* of pockets 214 assist in providing additional surface area to enhance lateral motion relative to the centerline 206.

Referring to FIGS. 11-14, another embodiment of an enhanced cleat 300 is disclosed. Cleat 300 includes a relatively large rearwardly facing directional pattern in the form of an arc-shaped recess 310 and an arc-shaped forward directional pattern 330 having a plurality of recesses and a rib. Rearwardly facing recess 310 extends from generally circular base 41 to generally circular end surface 42, and includes an arcuate sloped surface 312 that extends generally from end surface 42 to inner arcuate edge 311 that is spaced inward (relative to central axis 45) from the arcuate outer surface of base 41. Recess 310 extends circumferentially along an arc 310*a* adjacent the rear edge of cleat 300 approximately 200 degrees about central axis 45 and is bisected by centerline 306 so that half of recess 310 is on each side of the centerline. The circumferential ends of recesses 310 are defined by walls 340 and include an enlarged lateral recess or opening 320 adjacent each wall 340. A pair of projections 314 having sidewalls 314*a*, 314*b* extend rearwardly within recess 310 with one on each side of centerline 306 at an angle of approximately 30 degrees to centerline 306.

Forward directional pattern 330 includes a first recess 331 positioned along the centerline 306 with a projection 332 extending therefrom. First recess 331 includes lateral sidewalls 331*a*, 331*b* and projection 332 includes side edges 332*a*, 332*b*. Forward directional pattern 330 further includes a triangular recess 333 on opposite sides of the centerline 306. The triangular recesses 333 include a generally arcuate inner surface 333*a* and a forward surface 333*b* extending at a forward angle relative to centerline 306. Projections 314 are generally diametrically aligned with the forward portion of triangular recesses 333. The number and location of the projections and recesses may be varied as desired to vary the performance of cleat 300. Walls 340 extending between laterally opening recesses 320 and triangular recesses 333 generally provide a rearwardly extending surface 341 (FIG. 14) to increase engagement with the turf as the athlete moves generally in the forward direction and define a portion of the arcuate surface 333*a* of triangular recess 333 in order to also create a forwardly facing surface.

Referring to FIGS. 15-19, a cleat 400 according to a further embodiment is depicted. Cleat 400 includes a rearwardly facing directional pattern in the form of a triangular shaped recess 410 and an arc-shaped forward directional pattern 420 having a plurality of recesses and a rib. A pair of laterally opening recesses 430, 440 are positioned on both sides of centerline 306 and may be considered a third directional pattern that is symmetrical about the centerline 206. Rearwardly facing recess 410 includes a pair of flat walls 412 that extends generally from circular base 41 to circular end surface 42 and are spaced radially inward from the edge of base 41 to create flange 413. Flange 413 is thus generally triangular in shape with a pair of straight sides 413*a*, 413*b* connected by an arcuate side 413*c* along the outer edge of base 41. The rearwardly extending recess 410 extends along a circumferential arc 410*a* adjacent the rear edge of cleat 400 approximately 45 degrees about central axis 45 and is bisected by the centerline 406 so that half of recess 410 is on each side of the centerline.

Forward directional pattern 420 extends along a circumferential arc 420*a* adjacent the forward edge of cleat 400 approximately 60 degrees about central axis 45 and is bisected by centerline 406 so that half of pattern 420 is on each side of the centerline. Pattern 420 includes a pair of spaced apart surfaces 421 with a recess 422 therebetween along centerline 406. Recess 422 includes opposite sidewalls 422*a*, 422*b* and a projection 423 extending out of recess 422 along the centerline 406. Projection 423 includes oppositely facing side surfaces 423*a*, 423*b* and a forwardly facing surface 423*c*.

Two first laterally extending, generally triangular arcuate recesses 430 are positioned on opposite sides of centerline 406 and extend circumferentially between the rearwardly facing recess 410 and a transverse line 407 extending through central axis 45 and perpendicular to centerline 406. First lateral recesses 430 are defined by a generally arcuate rear wall 431 and a generally arcuate forward wall 432. A triangular opening 450 is located in the arcuate rear wall 431 between first lateral recess 430 and rearwardly facing recess 410.

Two second laterally extending, generally triangular arcuate recesses 440 are positioned on opposite sides of the centerline 406 and each extends between surface 421 of forward directional pattern 420 and arcuate forward wall 432. The various projections, walls and recesses provide numerous angled surfaces relative to centerline 406 to permit enhanced traction in multiple directions.

Figure 20:
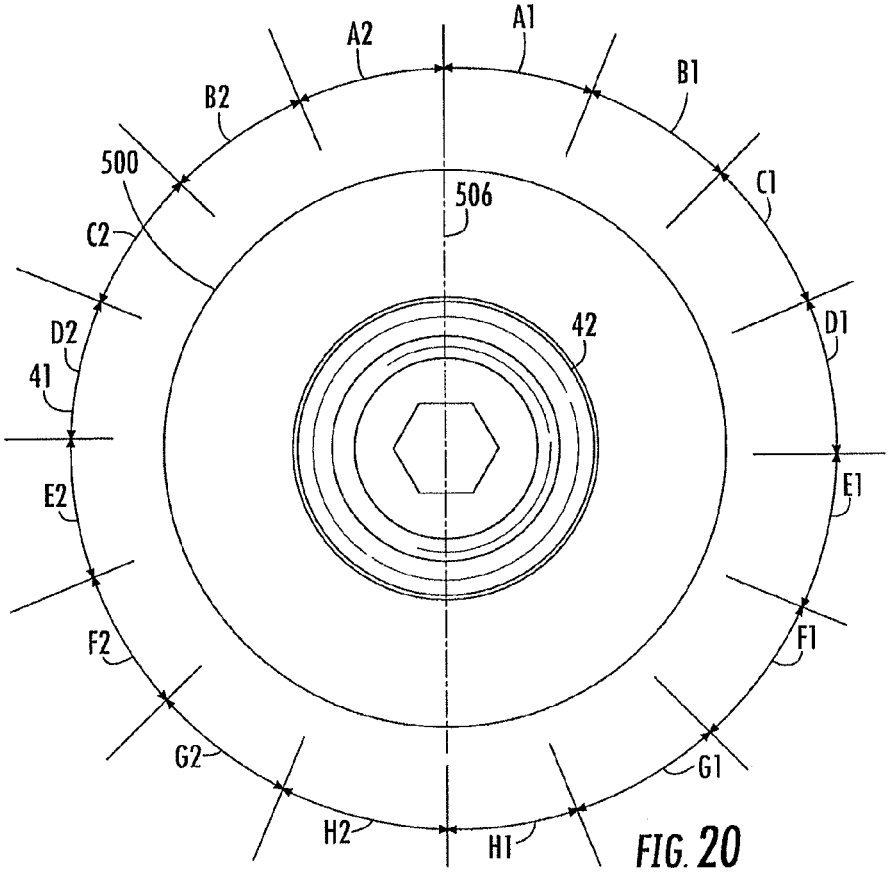
FIG. 20 is a top plan view of a generic cleat showing the cleat being divided into equal arcuate segments.
Figure 21:
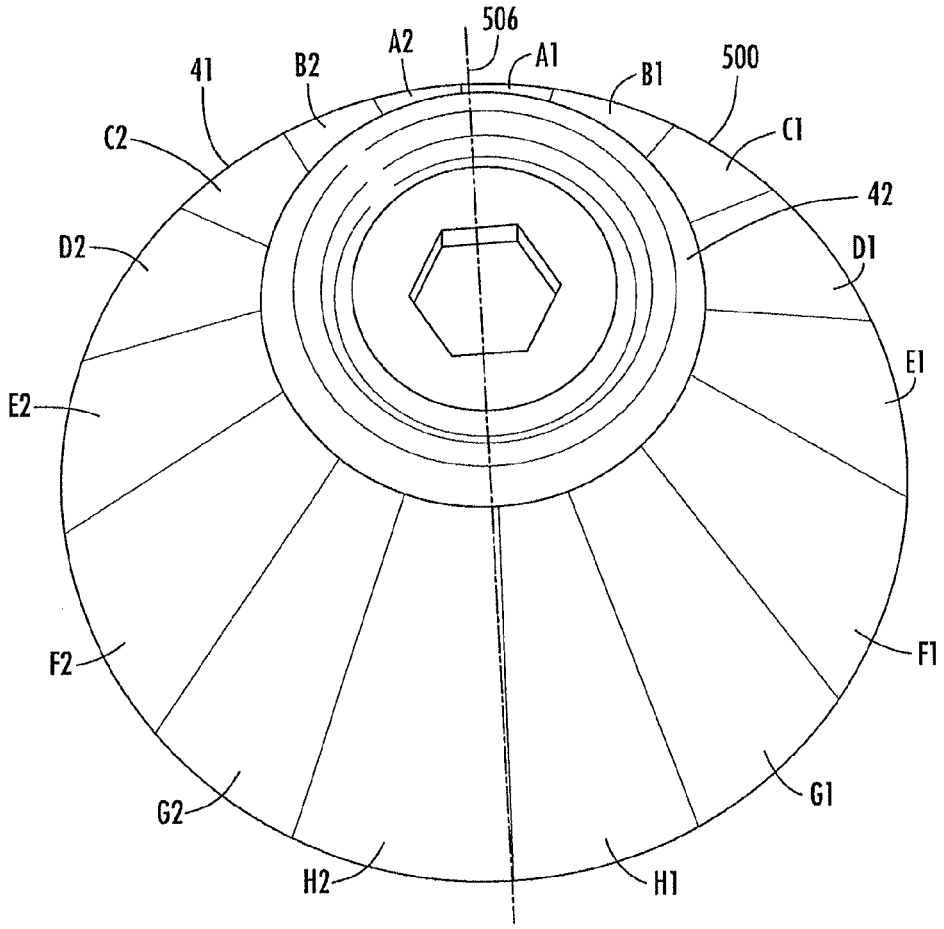
FIG. 21 is a perspective view of the generic cleat of FIG. 20 with the cleat oriented in an upside down manner.

FIGS. 20-21 depict a generic cleat design to further describe the aspects of the present disclosure. Cleat 500 is similar to the cleats described above in that it is generally frusto-conically shaped and includes a generally circular base 41 and a generally circular end surface 42 with a central bore 44 having a central axis 45. Centerline 506 divides the cleat in half and passes though central axis 45. In FIG. 20, cleat 500 is depicted as being divided into a series of sixteen equal arcs A1-H1, A2-H2 of 22.5 degrees each for purposes of this description. (It should be noted that the cleat could be divided into any number of equal arcs.) As a result, cleat 500 is shown in FIG. 21 as having an outer surface 507 formed of a series of sixteen non-planar arcuate sections or segments A1*s*-H1*s*, A2*s*-H2*s* that extend between base 41 and end surface 42. Each segment is defined by a chord extending along base 41, a second chord extending along end surface 42 and aligned with the chord of base 41 and a pair of lines along surface 507 interconnecting the two chords.

With respect to cleats 100, 200, 300, 400 described above, each of the cleats is symmetrical about its respective centerline. If cleat 500 is likewise symmetrical about its centerline 506, each of the non-planar segments is the mirror image of the corresponding non-planar segment on the opposite side of centerline 506 so that segment A1*s* is the mirror image of segment A2*s*, segment B1*s* is the mirror image of segment B2*s*, segment C1*s* is the mirror image of segment C2*s*, etc. As stated above, cleat 500 has been divided into sixteen equal segments for illustrative purposes but could be divided into any equal number of segments if the cleat is symmetrical about its centerline. In addition, a recess or other directional pattern may span multiple segments or only a fraction of a segment. If the cleat is symmetrical about its centerline, the corresponding segment on the opposite side of the centerline is identical.

With respect to cleats 100, 200, 300, 400, the corresponding segments A1*s*/A2*s*, B1*s*/B2*s*, C1*s*/C2*s*, etc. are mirror images of each other. If, however, a cleat is not symmetrical about its centerline, the corresponding segments (as well as the length of the corresponding arcs) do not need to be mirror images of each other. One instance in which this may occur is if cleats are specifically designated for either the right and left shoe. Another example could be when an athlete plays a particular position or has a style in which there is a greater need to turn in one direction rather than another.

In use, the athlete and potentially a trainer or technician would determine the desired characteristics for each region of the shoe based upon the athlete's skill set, position and the field conditions. A plurality of differently configured cleats are provided with each of the differently configured cleats providing different functionality. For example, as disclosed herein, four sets of cleats corresponding to cleats 100, 200, 300, 400 described above could be provided although greater or fewer sets of cleats could also be provided. Furthermore, the cleats described herein may also be manufactured in different lengths in order to provide still additional sets of cleats from which the athlete, trainer or technician may choose in order to customize the shoe for the athlete and the field conditions. When populating sole 32 with cleats, the cleat for each mounting location 33 is determined based upon the desired performance characteristics. The selected cleat is aligned with the desired mounting location 33 and a screw 50 is then inserted through the cleat and tightened while the cleat is maintained in its desired orientation.

Figure 22:
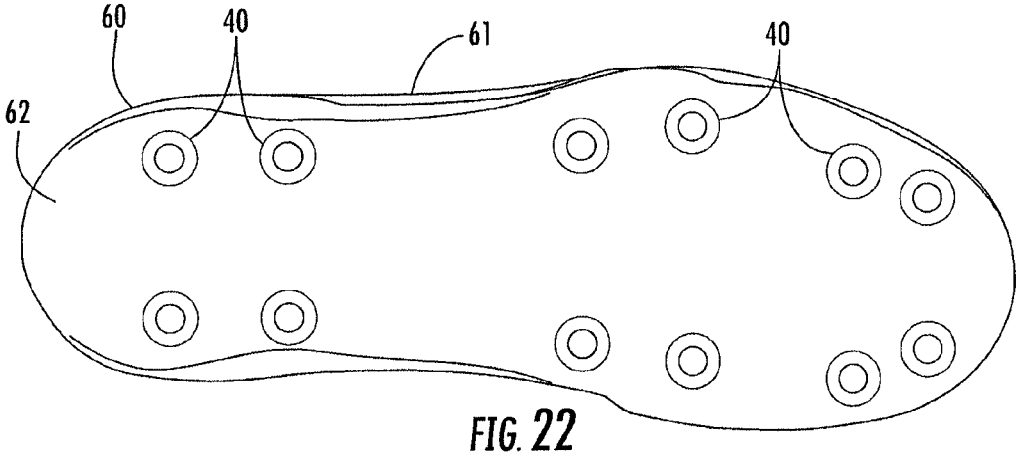
FIG. 22 is a bottom plan view of a shoe having generic cleats integrally formed with the sole of the shoe.

While shoe 30 and cleats 40, 100, 200, 300, 400 are configured to permit the removal and replacement or reconfiguration of the cleats, desired cleat configurations could also be integrally molded as part of the sole 62 of shoe 60 as depicted in FIG. 22. In such case, the cleats 40 would not include the central bore 44 and no screw 50 or other fastening device is necessary. The upper 61 of shoe 60 be may be identical or similar to that of shoe 30. The cleats 40 in FIG. 21 are depicted in a generic form and may be configured in a variety of different shapes as disclosed above depending upon the desired performance at the specific cleat location on the shoe.

Figure 23:
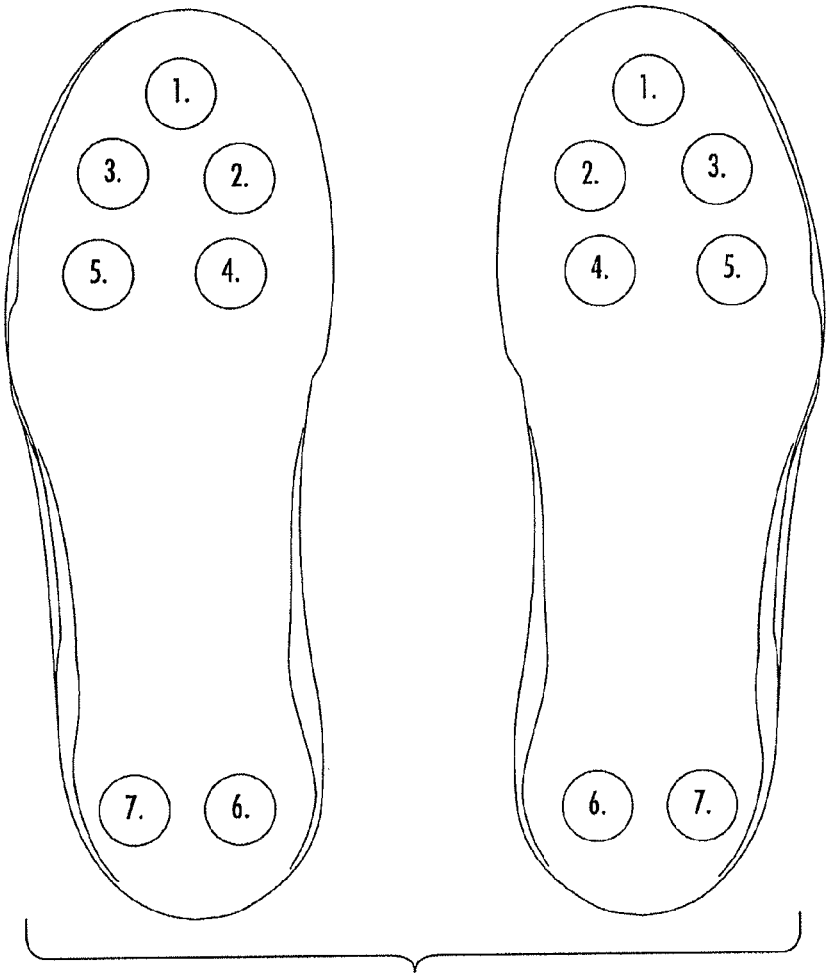
FIG. 23 is a bottom plan view of a pair of shoes having numbered cleats locations.

Referring to FIG. 23, a pair of athletic shoes with seven cleat positions (numbered 1-7) is depicted. When determining the type of cleat to be positioned at each cleat location, a person installing the cleats or a person designing the shoe would analyze the desired performance characteristics of the shoe based upon the predominant movements of the athlete who will be wearing the shoes as well as the anticipated field conditions to be encountered. Cleats may be chosen based upon each position but will likely be chosen based upon the function of the different regions of the foot. For example, particularly when playing sports, the posterior region of the foot has a different role as compared to the forefoot as well as the mid-foot. In addition, the inner and outer regions of the foot may also have different roles depending on the desired movement. According, it is desirable to optimize the cleat layout for each specific position and the performance characteristics specific to each athlete and their desired performance.

It is believed that upon reaching full stride, the cleats at the posterior portion of the shoe (positions 6 and 7) are not inserted into the ground and, therefore, forces are primarily applied to the forefoot during the contact period (i.e., when the foot is in contact with the ground). While running in a forward direction, forces are distributed from the mid-foot through the forefoot in a continuous forward motion thus utilizing each of the cleats in positions 1-5. When in medium to full stride (i.e., when the athlete's running motion is significantly faster than walking), the cleats in positions 4 and 5 enter the ground initially, directly followed by those of receptacles 2 and 3, and finally that of receptacle 1. As the forefoot exits the playing surface, the posterior features of the cleats of receptacles 1-5 apply a rearward force to generate forward movement propelling the individual.

The same system of forces apply when moving in lateral directions relative to the forward direction of the shoes. More specifically, lateral movement is achieved by applying a lateral force to the playing surface which results in lateral movement of the athlete. For example, cleat positions 3 and 5 of the left shoe generally facilitate lateral movement of the athlete in the direction to the right and cleat positions 3 and 5 of the right shoe operate in a similar, but opposite manner. Generally, lateral movement at a 90 degree angle to the longitudinal axis of the shoe would be generated primarily by forces from the outer lateral features of cleat positions 3 and 5 followed by the outer lateral features of cleat position 1 and lastly by the interior lateral features of cleat positions 2 and 4. When moving forwardly to the right at a 45 degree angle to the longitudinal axis of the left shoe, the outer lateral and posterior features of cleat positions 3 and 5 generally generate the primary forces followed by the outer lateral and posterior of cleat position 1 and lastly the interior lateral and posterior features of cleat positions 2 and 4.

When moving in rearward direction along the longitudinal axis of the shoe, the necessary forces are primarily generated by the anterior features of cleat position 1 followed by the anterior features of cleat positions 2 and 3 and lastly by the anterior features of cleat positions 4 and 5. In some circumstances, cleat positions 6 and 7 may also provide additional forces to assist in rearward movement.

When moving in a rearward direction to the right at a 45 degree angle to the longitudinal axis of the left shoe, the outer anterior and lateral features of cleat positions 1 and 3 generally generate the primary forces followed by the anterior and lateral features of cleat positions 2 and 5, and lastly by anterior and lateral features of cleat position 4. Cleat positions 6 and 7 may provide additional forces to assist rearward movement.

In general, the cleats located in the anterior portion of the shoe 30 (cleat positions 1-5) are used to generally facilitate rapid movement in any direction on a playing surface while cleats located on the posterior portion of the shoe (cleat positions 6 and 7) are generally used in a static situation (i.e., the foot is at rest). In addition, cleat positions 6 and 7 are also useful when increased balance and support are needed or in certain instances of rearward movement.

The movements and forces described above are generalizations and may vary based upon a variety of factors including the penetration of the cleats into the turf and the positioning of the cleats (including the angle of the central axis through the cleat relative to the turf) as well as the shoe to which they are attached. It should be noted that cleated shoes will increase traction on various playing surfaces and the concepts remain constant whether used on synthetic or natural playing surfaces.

Based upon the foregoing generalizations of movements and forces, Table 1 sets forth various examples for configuring cleat positions 1-7 in FIG. 23 with any of the four cleat structures depicted in FIGS. 3-19 based upon the type of movements typically used by a particular athlete when playing football. Such cleat configurations are arranged by football position and specify certain additional characteristics of each athlete. In Table 1, "P" designates the cleat depicted in FIGS. 3-7, "S" designates the cleat depicted in FIGS. 8-10, "B" designates the cleat depicted in FIGS. 11-14 and "A" designates the cleat depicted in FIGS. 15-19.

TABLE 1

7 STUDDED REPLACEMENT CLEAT POSITIONS

| | Cleat Positions | | | | | | |
|---|---|---|---|---|---|---|---|
| | 1 | 2 | 3 | 4 | 5 | 6 | 7 |
| Offense | | | | | | | |
| 1. Quarterback - Drop Back - Under Center - Throw from Pocket | P | B | A | B | A | B | B |
| 2. Quarterback - Drop Back - Under Center - Make Plays with Feet | P | S | A | S | A | B | B |
| 3. Quarterback - Drop Back - Shot Gun - Throw from Pocket | A | B | A | B | A | B | B |
| 4. Quarterback - Drop Back - Shot Gun - Make Plays with Feet | A | S | A | S | A | B | B |
| 5. Quarterback - Dual Threat - Throw on the Run | A | S | A | S | A | B | B |
| 6. Quarterback - Dual Threat - Make Plays with Feet | S | S | A | S | A | B | B |
| 7. Running Back - Downhill - Avoid Contact | S | S | A | S | A | A | S |
| 8. Running Back - Downhill - Power Through | S | S | A | S | A | P | S |
| 9. Running Back - Weapon Back - Speed | A | S | A | S | A | A | S |
| 10. Running Back - Weapon Back - Agility | A | S | A | S | A | A | A |
| 11. Running Back - Wing Back - Speed | S | S | A | S | A | S | S |
| 12. Running Back - Wing Back - Agility | S | S | A | S | A | A | A |
| 13. Fullback - Power | P | P | P | P | P | B | B |
| 14. Fullback - Speed | P | P | P | S | S | B | B |
| 15. Wide Receiver - Vertical Threat - Speed Release | S | S | A | S | A | A | A |
| 16. Wide Receiver - Vertical Threat - Rapid Foot Fire | A | S | A | S | A | A | A |
| 17. Wide Receiver - Catch & Go - Speed Release | S | S | A | A | A | A | A |
| 18. Wide Receiver - Catch & Go - Rapid Foot Fire | A | S | A | A | A | A | A |
| 19. Tight End - 3-point - Stay in the Box & Block | P | P | P | P | B | B | B |
| 20. Tight End - 3-point - Release for Routes | P | P | B | S | B | B | B |
| 21. Tight End - Flex - Release for Routes | P | S | A | S | A | B | B |

TABLE 1-continued

| 7 STUDDED REPLACEMENT CLEAT POSITIONS | Cleat Positions | | | | | | |
|---|---|---|---|---|---|---|---|
| | 1 | 2 | 3 | 4 | 5 | 6 | 7 |
| 22. Tight End - Flex - Charge the Box | P | P | A | A | A | B | B |
| 23. Tight End - Multiple Sets - Backfield | P | P | P | P | A | B | B |
| 24. Tight End - Multiple Sets - In Motion | P | P | P | A | A | B | B |
| 25. Offensive Line - Center - Run Block | P | P | P | P | P | P | B |
| 26. Offensive Line - Center - Pass Block | P | P | P | P | P | B | B |
| 27. Offensive Line - Guard - Run Block - Pull | P | P | P | B | A | B | B |
| 28. Offensive Line - Guard - Run Block - No Pull | P | P | P | B | P | B | B |
| 29. Offensive Line - Guard - Pass Block | P | P | P | B | B | B | B |
| 30. Offensive Line - Tackle - Run Block | P | P | P | P | B | B | B |
| 31. Offensive Line - Tackle - Pass Block | P | P | P | B | B | B | B |
| Defense | | | | | | | |
| 32. Defensive Line - End - Bull Rush | P | P | P | P | A | B | B |
| 33. Defensive Line - End - Quick Moves | P | P | A | P | A | B | B |
| 34. Defensive Line - Tackle - Power Through | P | P | P | P | P | P | B |
| 35. Defensive Line - Tackle - Lateral Movements | P | P | P | P | A | B | B |
| 36. Defensive Line - Nose Guard - 3 Linemen | P | P | P | P | P | P | B |
| 37. Defensive Line - Nose Guard - 4 Linemen | P | P | P | P | A | P | B |
| 38. Linebacker - Inside - 4/3 | P | P | A | P | A | B | B |
| 39. Linebacker - Inside - 3/4 | P | P | A | S | A | B | B |
| 40. Linebacker - Outside - 4/3 | P | S | A | S | A | P | S |
| 41. Linebacker - Outside - 3/4 | P | P | A | P | A | P | S |
| 42. Defensive Back - Corner - Man to Man | A | S | A | S | A | S | S |
| 43. Defensive Back - Corner - Zone | A | A | A | A | A | S | S |
| 44. Defensive Back - Safety - Accelerate Downhill | S | S | A | S | A | S | S |
| 45. Defensive Back - Safety - Deep Middle | S | S | A | A | A | S | S |
| Skill Sets (play either or both sides of the ball) | | | | | | | |
| 46. Speed & Agility - Sudden Change of Direction | A | A | A | S | A | A | S |
| 47. Speed & Agility - Bursts of Speed | S | S | A | S | A | A | S |
| 48. Speed & Agility - Combination of Both | A | S | A | S | A | A | S |
| 49. Power & Speed - Powerful Base | P | P | B | P | B | B | B |
| 50. Power & Speed - Extended from the Box | P | P | A | S | S | B | B |
| 51. Power & Balance - Hold Base | P | P | P | B | B | B | B |
| 52. Power & Balance - Power Through | P | P | P | P | P | B | B |

Although the disclosure provided has been described in terms of illustrated embodiments, it is to be understood that the disclosure is not to be interpreted as limiting. Various alterations and modifications will no doubt become apparent to those skilled in the art after having read the above disclosure. Accordingly, numerous other embodiments, modifications and variations within the scope and spirit of the appended claims will occur to persons of ordinary skill in the art from a review of this disclosure.

The invention claimed is:

1. A shoe with cleats comprising:

a sole;

a plurality of generally frusto-conical first cleats on the sole, each first cleat having a pair of spaced apart first cleat recesses and a first cleat central axis, each first cleat being rotationally asymmetrical about the first cleat central axis, each one of the pair of first cleat recesses having different widths; and a plurality of generally frusto-conical second cleats on the sole, each second cleat having a pair of spaced apart second cleat recesses and a second cleat central axis, each second cleat being rotationally asymmetrical about the second cleat central axis, each one of the pair of second cleat recesses having different widths, the first and second cleats being differently configured.

2. The shoe of claim 1, wherein the sole has a plurality of spaced apart cleat receiving receptacles for detachably mounting the cleats to the sole.

3. The shoe of claim 2, wherein each cleat includes a central bore extending generally along the central cleat axis of the cleat and a fastening member extending through the bore and being removably secured to the sole.

4. The shoe of claim 1, wherein each cleat has a generally circular base with a base central axis and a generally circular end surface with an end surface central axis, the base and end surface central axes being generally coincident to define the cleat central axis.

5. The shoe of claim 1, wherein the cleats are permanently mounted to the sole.

6. The cleat of claim 1, wherein each of the first cleat recesses extends at least approximately 110° about the first cleat central axis and each of the second cleat recesses extends at least approximately 110° about the second cleat central axis.

7. The cleat of claim 1, further including at least one projection extending from one of the first cleat recesses of each first cleat.

8. The cleat of claim 7, wherein the at least one projection is generally aligned with the bisecting plane.

9. A shoe with cleats comprising:

a sole; and a plurality of cleats located on the sole, each cleat having:

a generally circular base generally adjacent the sole, the base having a base central axis;

a generally circular end surface spaced from the sole, the end surface having an end surface central axis, the base central axis and the end surface central axis being generally coincident to define a cleat central axis, the base being larger than the end surface;

an outer generally arcuate engaging surface extending between the base and the end surface; and the outer generally arcuate engaging surface including a first directional pattern and a second directional pattern, the first directional pattern being generally symmetrically configured relative to a bisecting plane extending through the base and the end surface of each cleat, the first directional pattern having at least one first recess, and the second directional pattern being generally symmetrically configured relative to the bisecting plane and having at least one second recess, each of the first and second recesses having a different arcuate length extending around the outer generally arcuate engaging surface approximately midway between the base and the end surface.

10. The shoe of claim 9, wherein the sole is generally elongated and has a longitudinal axis, and the bisecting planes of the cleats extend generally parallel to the longitudinal axis of the sole.

11. The shoe of claim 9, wherein each each cleat being asymmetrical about its central axis.

12. The shoe of claim 11, wherein each cleat includes a central bore extending generally along its central axis and a fastening member extending through the bore and being removably secured to the sole.

13. The shoe of claim 9, wherein the first recess extends generally from the base to the end surface, the second recess extends generally from the base to the end surface and the first and second recesses face in opposite directions.

14. The shoe of claim 9, wherein the bisecting plane of each cleat defines first and second cleat halves and the first and second cleat halves are a mirror image of each other.

15. The shoe of claim 9, wherein the sole has a plurality of spaced apart cleat receiving receptacles for detachably mounting the cleats to the sole.

16. The shoe of claim 9, wherein the cleats are permanently mounted to the sole.

17. The cleat of claim 9, wherein each of the first directional pattern and the second directional pattern extend at least approximately 110° about the cleat central axis.

18. The cleat of claim 9, wherein the first and second recesses slope from the base to the end surface at different rates.

19. The cleat of claim 9, further including additional recesses that open generally laterally relative to the bisecting plane.

20. A shoe with cleats comprising:

a sole having a plurality of cleats thereon at spaced apart locations;

each cleat having a central axis, a circular base generally adjacent the sole and a circular end surface spaced from the sole, the circular base and the circular end surface being substantially parallel, a path between the base and the end surface defining a cleat envelope between the base and the end surface;

at least one first cleat including a pair of spaced apart first directional patterns in the cleat envelope thereof, the first cleat being rotationally asymmetrical about the first cleat central axis; and at least one second cleat including a pair of spaced apart second directional patterns in the cleat envelope thereof, the second cleat being rotationally asymmetrical about the second cleat central axis, the at least one second cleat being configured differently from the at least one first cleat.

21. The shoe of claim 20, wherein the pair of first directional patterns includes at least one first recess and the pair of second directional patterns includes at least one second recess, the first and second recesses being differently shaped.

22. The shoe of claim 20, wherein the cleats are permanently mounted to the sole.

23. The shoe of claim 20, wherein the sole has a plurality of spaced apart cleat receiving receptacles for detachably mounting the cleats to the sole.

24. The cleat of claim 23, wherein each cleat further includes a visual indicator to assist in orienting the cleat when mounting the cleat on the shoe.

25. The cleat of claim 20, wherein the pair of first directional patterns slope from the base to the end surface at different rates and the pair of second directional patterns slope from the base to the end surface at different rates.

26. The cleat of claim 20, wherein the pair of first directional patterns are located on opposite sides of a bisecting plane extending through the base and the end surface of the first cleats and the pair of second directional patterns are located on opposite sides of a bisecting plane extending through the base and the end surface of the second cleats.

* * * * *